US007296374B2

(12) United States Patent
Weyrauch et al.

(10) Patent No.: US 7,296,374 B2
(45) Date of Patent: Nov. 20, 2007

(54) IDENTIFICATION PLATE FOR PALLET CONTAINER, AND METHOD OF ATTACHING AN IDENTIFICATION PLATE TO A PALLET CONTAINER

(75) Inventors: Detlev Weyrauch, Kreuzach-Obermaubach (DE); Klaus-Peter Schmidt, Bonn (DE); Dietmar Przytulla, Kerpen (DE); Ernst Wurzer, Königswinter (DE)

(73) Assignee: Mauser-Werke GmbH & Co. K.G., Brühl (DE)

( * ) Notice: Subject to any disclaimer, the term of this patent is extended or adjusted under 35 U.S.C. 154(b) by 0 days.

(21) Appl. No.: 11/465,553

(22) Filed: Aug. 18, 2006

(65) Prior Publication Data

US 2006/0288620 A1 Dec. 28, 2006

Related U.S. Application Data

(63) Continuation of application No. PCT/EP2006/003325, filed on Apr. 11, 2006.

(51) Int. Cl.
*G09F 3/18* (2006.01)

(52) U.S. Cl. ..... 40/661.08; 40/642.05; 40/308; 220/9.1

(58) Field of Classification Search ..... 40/308, 40/642.02, 651, 661.08, 663, 666; 220/9.1
See application file for complete search history.

(56) References Cited

U.S. PATENT DOCUMENTS 2,723,474 A * 11/1955 Minter ..... 40/651
4,955,154 A * 9/1990 Moss ..... 40/663
5,058,747 A * 10/1991 Decroix et al. ..... 206/599
5,450,681 A 9/1995 Stolzman
5,526,598 A * 6/1996 Watanabe ..... 40/308
5,787,623 A 8/1998 Schutz
6,244,453 B1 6/2001 Maschio
6,390,331 B2 * 5/2002 Schutz ..... 222/105
6,550,628 B1 * 4/2003 Sedlmayr ..... 220/9.1
6,694,683 B2 * 2/2004 Anderson et al. ..... 52/204.5
7,165,349 B2 * 1/2007 Bauer ..... 40/654
2004/0068907 A1 * 4/2004 Bazany et al. ..... 40/642.02
2004/0089659 A1 * 5/2004 Schutz ..... 220/9.1
2004/0226206 A1 * 11/2004 Park et al. ..... 40/651

* cited by examiner

*Primary Examiner*—Gary C. Hoge
(74) *Attorney, Agent, or Firm*—Henry M. Feiereisen; Ursula B. Day

(57) ABSTRACT

An identification plate for a pallet container includes a plate body for placement upon a lattice frame of a pallet container. The plate body has an upper edge, which is bent rearwards at a first angle for attachment to an upper horizontal rod of the lattice frame, a lower edge, which is bent rearwards at the first angle for attachment to a lower horizontal rod of the lattice frame, and opposite lateral edges extending between the upper and lower edges and bent rearwards at a second angle which is greater than the first angle. Each of the lateral edges ends at its rear in a rolled edge and is formed with terminal recesses for receiving the upper and lower horizontal rods. The rolled edge is hereby sized to project with its ends in a rod-like manner into the recesses to engage behind the upper and lower horizontal rods.

18 Claims, 3 Drawing Sheets

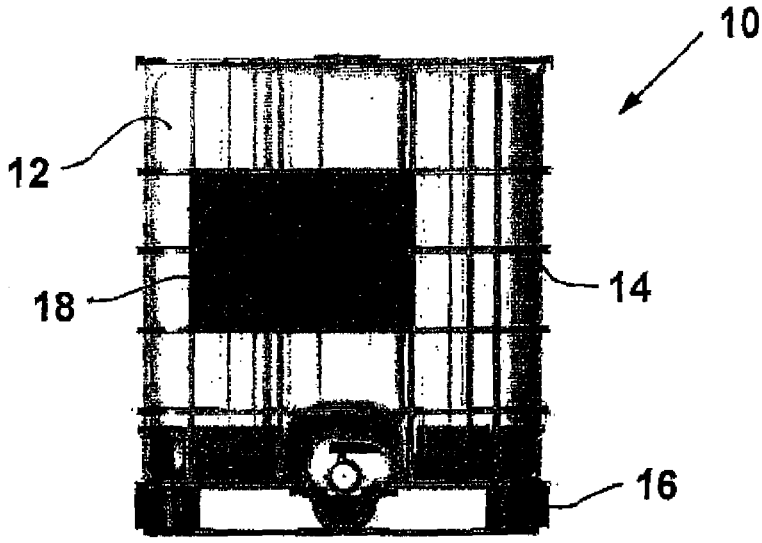
Fig. 1
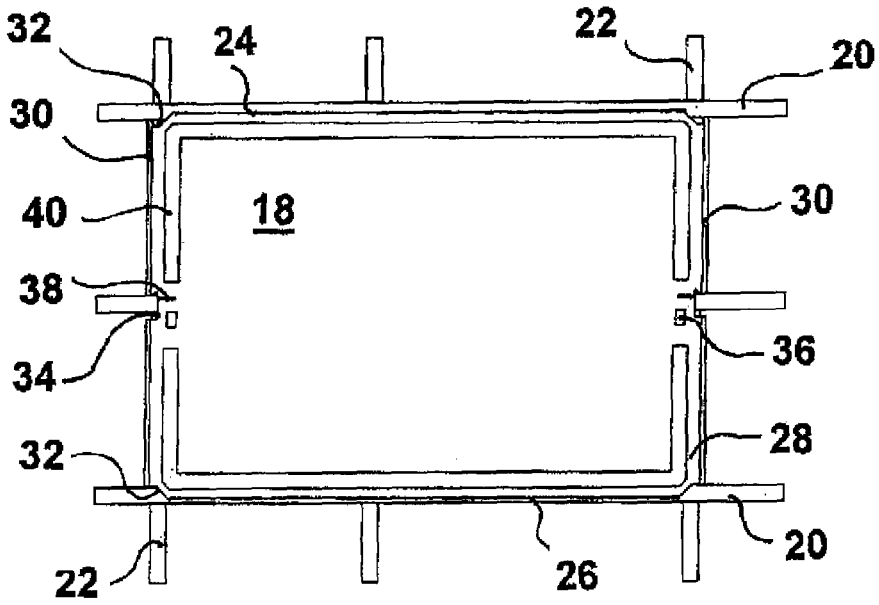
Fig. 2
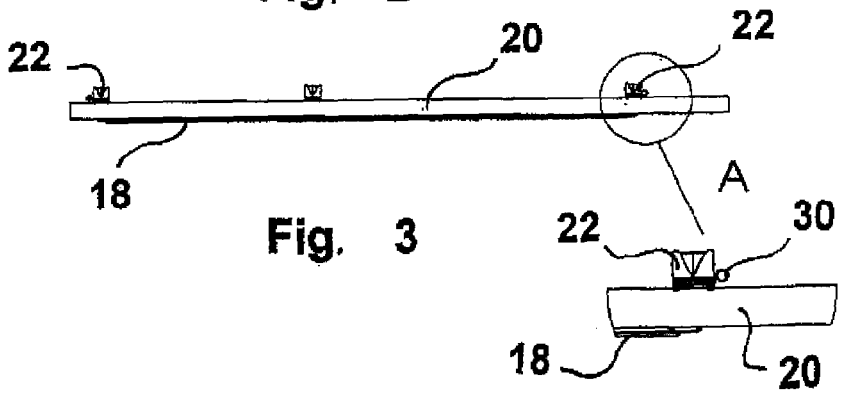
Fig. 3
Fig. 3a

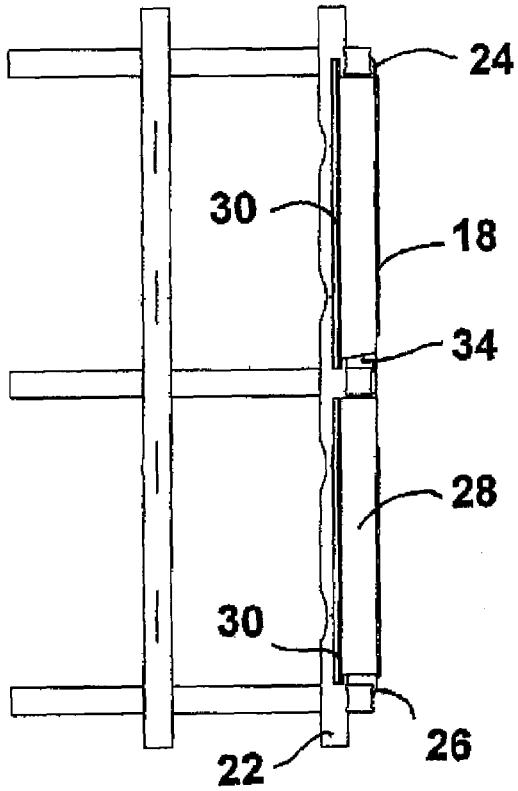
Fig. 6
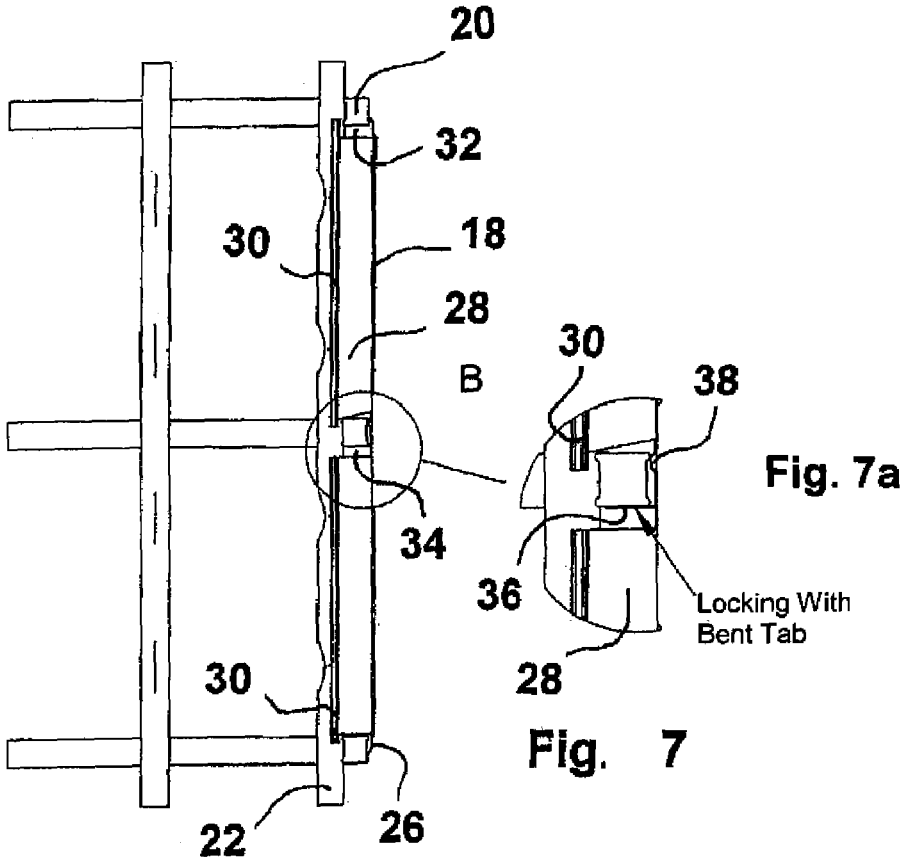
Fig. 7a
Fig. 7

IDENTIFICATION PLATE FOR PALLET CONTAINER, AND METHOD OF ATTACHING AN IDENTIFICATION PLATE TO A PALLET CONTAINER

CROSS-REFERENCES TO RELATED APPLICATIONS

This application is a continuation of prior filed copending PCT International application no. PCT/EP2006/003325, filed Apr. 11, 2006, which designated the United States and on which priority is claimed under 35 U.S.C. §120, and which claims the priority of German Patent Application, Serial No. 20 2005 006 351.7, filed Apr. 20, 2005, pursuant to 35 U.S.C. 119(a)-(d), the contents of which are incorporated herein by reference.

BACKGROUND OF THE INVENTION

The present invention relates to an identification plate for a pallet container for storage and transport of liquid or free-flowing materials.

Nothing in the following discussion of the state of the art is to be construed as an admission of prior art.

A pallet container of a type involved here includes an inner thin-walled plastic container having an upper fill opening and a lower drain valve, a lattice frame disposed in close surrounding relationship to the plastic container and having horizontal and vertical lattice rods which are welded together, and a bottom plate on which the plastic container is supported and on which the lattice frame is mounted. The bottom plate may be constructed as simple wooden pallet, as steel frame pallet, or as plastic pallet.

A pallet container in lightweight construction with a fill volume of about 1,000 l is disclosed, e.g., in U.S. Pat. No. 6,244,453, which describes a lattice frame of quadrilateral tubes and is used for transport of liquid or free-flowing materials. The pallet container may be used for the transport and storage of hazardous liquid materials like chemicals (e.g. solvents, acids etc.), only when passing the inspection tests by an authorized official institution and receiving a registration number. Typically, each pallet container has mounted on the lattice frame on the side of the discharge fitting an identification plate (label plate) on which a respective information sheet is glued or placed in an attached transparent pocket for identification of the respective content, content manufacturer, pallet manufacturer, registration number, or similar data. Some manufacturers secure the identification plates through a bolted connection onto two or three horizontal rods of the lattice frame. Such bolted connections by means of four or six bolts are time-consuming and may result in injuries as a consequence of the protruding bolt heads.

An identification plate or lettering plate without bolted connections is disclosed in U.S. Pat. No. 5,787,623. The pallet container has lattice rods which are designed as round tubes and drawn in at the intersection points for formation of trough-shaped double-walled depressions which extend in longitudinal direction of the lattice rods so that the lattice rods which are welded together at the intersection points lie approximately in a plane (round tube lattice frame). The lettering plate mounted thereon has a lower support edge which is beveled or flanged outwardly and which abuts a lower horizontal lattice rod and engages behind the latter, whereas the upper edge is designed as a clawed edge and in the mounted state of the lettering plate fits behind an upper horizontal lattice rod thereby resiliently bracing the lettering plate. This is disadvantageous because on one hand the edges which reach behind the horizontal lattice rods can touch the thin-walled inner plastic container, in particular when a filled inner container bulges outwards between two vertical rods and is exposed to shaking during transport, and on the other hand anyone is able to overcome the resilient bracing by hand without any further aids in order to remove and manipulate (e.g. exchange) the sheet metal plate without authorization. According to a modified configuration, the sheet metal plate is provided on the upper side of the outer edges with particular insert sleeves for plastic clamp pins which fit in the mounted state of the plate with their head into the trough-shaped depressions of the upper horizontal lattice rods and thereby fix the plate. A seal of originality may be provided in the form of an additional push button with a web, which spreads like a wedge, and bolts, which are attached by film hinges and must be pressed into a particularly provided depression on the upper edge of the sheet metal plate. This construction is disadvantageous because of the need for additional plastic securing elements which may become brittle through exposure to weather influences and may easily break off when subjected to impacts.

It would therefore be desirable and advantageous to provide an improved identification plate for attachment to a pallet container to obviate prior art shortcomings and to allow easy securement without additional fastening or securing means.

SUMMARY OF THE INVENTION

According to one aspect of the present invention, an identification plate for a pallet container includes a plate body for placement upon a lattice frame of a pallet container, with the plate body having an upper edge, which is bent rearwards at a first angle for attachment to an upper horizontal rod of the lattice frame, a lower edge, which is bent rearwards at the first angle for attachment to a lower horizontal rod of the lattice frame, and opposite lateral edges extending between the upper and lower edges and bent rearwards at a second angle which is greater than the first angle, wherein each of the lateral edges ends at its rear in a rolled edge and is formed with terminal recesses for receiving the upper and lower horizontal rods, wherein the rolled edge is sized to project with its ends in a rod-like manner into the recesses to engage behind the upper and lower horizontal rods.

In the identification panel according to the invention the upper edge and lower edge are slight beveled (bent) to the rear and abut in the mounted state over the entire length—without any recess for a covered vertical rod—against the outwardly pointing surface of an upper and a lower horizontal rod, while both lateral edges are beveled (bent) to the rear to a comparably greater extent and respectively rolled up at their rear end to form a rolled edge, wherein both lateral bevels have respective recesses in the metal sheet for the upper and lower horizontal rods, and wherein the rolled edge is extended by a piece in rod-like manner upwards and downwards, projects into these recesses, and engages behind the upper and lower horizontal rod. This enables a simple and secure attachment of the identification plate to the lattice frame. It is hereby provided in accordance with a configuration of the invention that the respective distances or a firm abutment under slight prestress of the upper and the lower edge from the upper and lower horizontal rods or the right and left rolled edge from the respective right and left vertical rods are predeterminable by the degree of the bevels or the bevel angle of the upper and/or lower edge or/and both lateral borders of the identification plate, such as to ensure a rattle-free securement with immovable firm seat.

According to another feature of the present invention, the first and second angles can be so selected as to adjust a distance of the upper and lower edges from the upper and lower horizontal rods and a distance of the lateral edges from respective vertical rods of the lattice frame so as to ensure a rattle-free securement to the lattice frame.

According to another feature of the present invention, each of the lateral edges of the plate body may have a further recess approximately in midsection for attachment to a further horizontal rod between the upper and lower horizontal rods, with the rolled edge of the lateral edge being sized to respectively project into the further recess and engaging behind the further horizontal rod. Thus, when the identification plate is of suitable size and a further horizontal rod is covered, a respective recess is provided for the covered horizontal rod approximately in midsection of each of both lateral bevels, with the rolled edge being extended downwards by a piece in rod-like manner, projecting from atop into these recesses and engaging behind the covered horizontal rod.

According to another feature of the present invention, the plate body has a front face which may be formed with at least one U-shaped punched-out section disposed at a location directly below the further horizontal rod and provided with a tab appended on one side of the U-shaped section and bent rearwards to extend horizontally flatly from below against the further horizontal rod to form a seal of originality. As an alternative or in addition, the plate body may have a tab which is bent rearwards to extend flatly against a vertical rod and vertically directly under the further horizontal rod.

According to another feature of the present invention, the plate body has a front face which may be formed with a lateral rib-shaped dimple disposed at a location immediately above the further horizontal rod for abutment against an outwardly pointing surface of the further horizontal rod.

According to another feature of the present invention, the plate body has a front face which may be formed with a wraparound bead-shaped structure at an outer area of the front face, with the structure being breached in midsection in an area of the further horizontal rod.

According to another aspect of the present invention, a method of attaching an identification plate to a lattice frame of a pallet container, includes the steps of providing an identification plate with upper and lower edges bent rearwards at a first angle, and opposite lateral edges extending between the upper and lower edges and bent rearwards at a second angle which is greater than the first angle, wherein each of the lateral edges ends at its rear in a rolled edge sized to jut out, angling the identification plate in relation to a first horizontal rod of the lattice frame to thereby position the upper edge of the identification plate against the first horizontal rod and engage the rolled edge behind the first horizontal rod, pivoting the identification plate in a direction toward the lattice frame until the rolled edge reaches behind a second horizontal rod of the lattice frame below the first horizontal rod, pivoting the identification plate further in a direction toward the lattice frame until the lower edge of the identification plate engages a third horizontal rod of the lattice frame below the second horizontal rod and the rolled edge reaches behind the third horizontal rod, and pushing the identification plate downwards to engage the rolled edge behind the second horizontal rod and to engage the rolled edge behind the third horizontal rod.

According to another feature of the present invention, dimples formed in midsection of the identification plate may be locked behind an elevated edge of the second horizontal rod.

BRIEF DESCRIPTION OF THE DRAWING

Other features and advantages of the present invention will be more readily apparent upon reading the following description of currently preferred exemplified embodiments of the invention with reference to the accompanying drawing, in which:

FIG. 1 is a frontal view of a pallet container with identification plate according to the invention;

FIG. 2 is a frontal view of an attached identification plate according to the invention;

FIG. 3 is a plan view of the identification plate;

FIG. 3*a* is an enlarged detailed view of the area encircled in FIG. 3 and marked "A";

FIG. 6 is a schematic illustration of a next following mounting step of the identification plate onto the pallet container;

FIG. 7 is a schematic illustration of a clamped securement of the identification plate onto the pallet container; and FIG. 7*a* is an enlarged detailed view of the area encircled in FIG. 7 and marked "B";

DETAILED DESCRIPTION OF PREFERRED EMBODIMENTS

Figure 4:
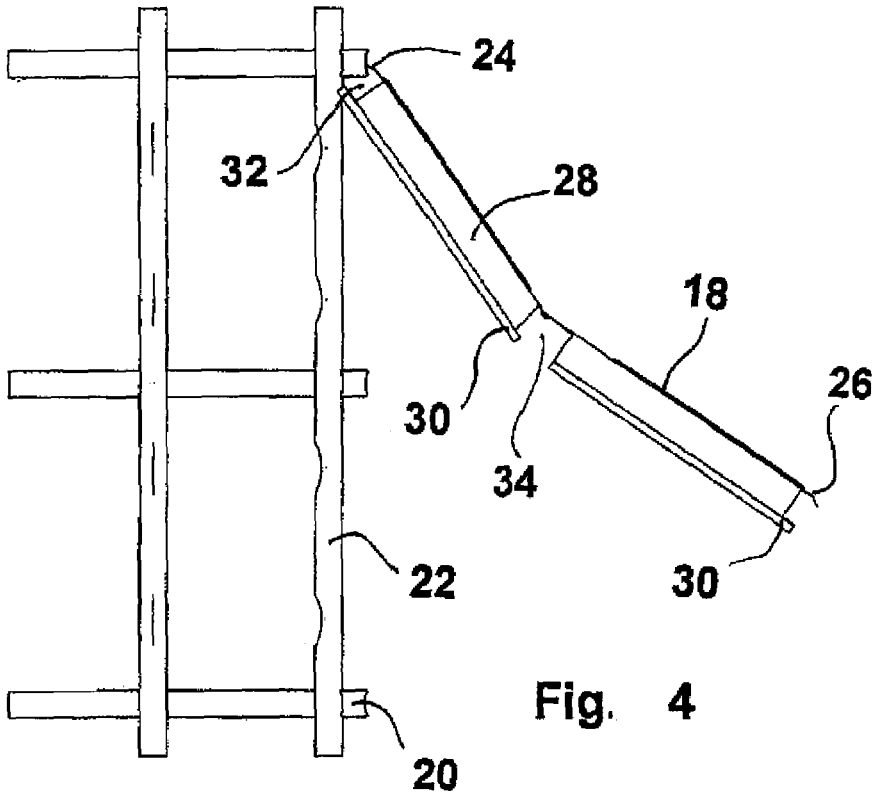
FIG. 4 is a schematic illustration of an initial mounting step of the identification plate onto the pallet container.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a frontal view of a pallet container, generally designated by reference numeral 10, and have attached thereon an identification plate 18 according to the present invention. The pallet container 10 can be used for storage and transport of liquid or free-flowing materials and includes an inner thin-walled plastic container 12 having an upper fill opening and a lower drain valve, a lattice frame 14 disposed in close surrounding relationship to the plastic container 12 and having horizontal lattice rods 20 and vertical lattice rods 22 which are welded together, and a bottom plate 16 on which the plastic container 12 is supported and on which the lattice frame 14 is mounted. The horizontal and vertical lattice rods 20, 22 have a square profile (FIG. 7). In this tube profile, the outwardly and inwardly directed side surfaces of the jointly welded horizontal and vertical lattice rods have on both edges a raised rim and a lower center area such that a defined four-point support is formed at the intersections points of the tubular rods for ensuring optimum welding (projection welding) of the lattice tubes. The tubular rods do not extend in a plane but in two tube planes on top of one another so that the resultant lattice frame—compared to a conventional lattice frame with dented round tubes extending approximately in a same plane—have enhanced buckling strength.

Secured above the discharge fitting to the outside of the lattice frame 14 by way of a snap-locking connection (snap fit) is an identification plate 18 according to the invention. As shown by the exemplary embodiment of FIG. 2, the identification plate 18 has a rectangular plate body having a broadside of a width of about 550 mm and a height of about 385 mm and being made from a very thin galvanized steel sheet of a thickness of only 0.6 mm. The upper edge 24 and lower edge 26 of the identification plate 18 rest externally upon an upper and a lower horizontal lattice rod 20. Since the edgings of the upper and lower edge 24, 26 are slightly beveled to the rear by about 30° over a width of 8 mm and terminate in the lower center area of the square horizontal rod 20, there is no possibility to grab the edge 24, 26 with the fingers (no risk of injury).

The lateral edges 28 of the identification plate 18 are beveled to the rear by about 75° as bevels in the form of broad strips of about 25 mm, i.e. bent to a comparably greater degree, and are rolled up on their rearward end to the outside to form a rolled edge 30. Both rolled edges 30 have hereby only a small diameter of merely about 5 mm.

Figure 5:
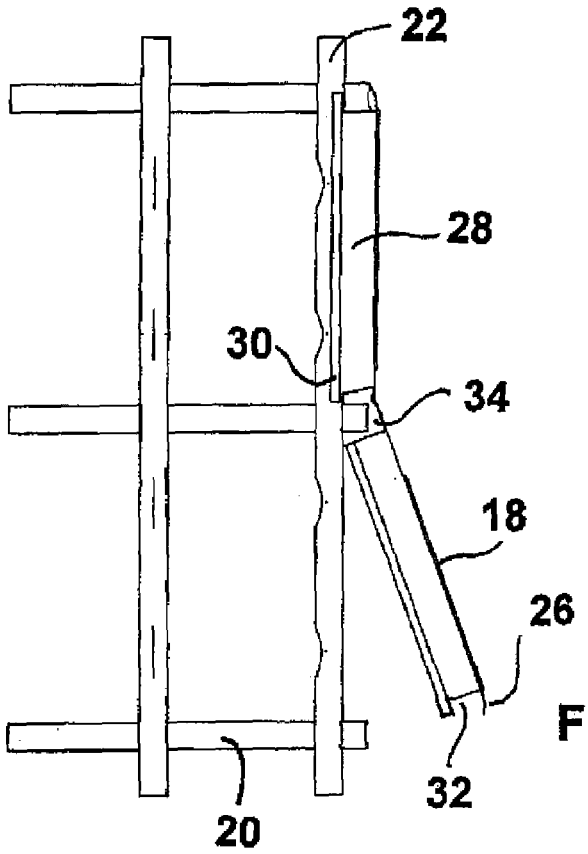
FIG. 5 is a schematic illustration of a next mounting step of the identification plate onto the pallet container.

FIGS. 3 and 3*a* clearly show by way of a plan view the securement of the identification plate 18 to the horizontal rods 20 and depict the positioning of each rolled edge 30 behind a horizontal rod 20 and at the same time abutting from outside upon a vertical rod 22. FIGS. 4, 5, and 6 show the various mounting steps of the identification plate 18 according to the invention onto the lattice frame 14. In FIG. 4, the upper edge 24 of the identification plate 18 is placed from outside against an upper horizontal rod 20 so that the rolled edge 30 projecting into an upper recess 32 engages from bottom to top behind the upper horizontal rod 20. Next—as shown in FIG. 5—the lower part of the identification plate 18 is swung inwards so that the rolled edge 30 projecting from top to bottom into a central recess 34 reaches behind the center horizontal rod 20. Finally, the identification plate 18 is fully swung inwards in FIG. 6 until the lower edge 26 strikes against the outwardly directed surface of the lower horizontal rod 20 so that the rolled edge 30 projecting from top to bottom into a lower recess 32 reaches behind the lower horizontal rod 20. The sheet metal plate 18 is finally secured by shifting the latter by about 6 mm downwards so that the rolled edge 30 in the central recess 34 engages from top to bottom behind the center horizontal rod 20, and the rolled edge 30 in the lower recess 32 engages from top to bottom behind the lower horizontal rod 20, wherein the upwardly pointing rolled edge 30 in the upper recess 32 is designed long enough to still engage the upper horizontal rod 20 by about 5 mm from bottom to top.

FIG. 7 shows the identification plate 18 in its final position. As clearly shown in FIG. 7*a*, two dimples 38 are arranged respectively on the outside in the middle of the identification plate 18 and reach behind the upper raised edge of the center horizontal rod 20 so that the plate is firmly seated immovably. Finally, both tabs 36 are bent from below against the center horizontal rod 20 to form a seal of originality, and the sheet metal plate can be detached from the lattice frame only by means of a respective tool. According to a slightly different variation that is provided for exposure to great stress, the U-shaped sections are rotated by 90° so that the tabs 36 are articulated on the side. The immovable securement of the identification plate 18 is realized by bending these vertically aligned tabs to the rear flatly against a vertical rod 22 and vertically directly below a horizontal rod 20. This seal of originality can be bent back only when the pallet container is reconditioned, i.e. when the inner plastic container is removed, in the event the identification plate should be detached and exchanged. At slightest tolerance values (no rattling), the vertical tab 36 has a greater section modulus in axial direction in relation to the horizontal rod lying above, and an inadvertent bending back is impossible.

The front surface of the identification plate 18 is provided with a wraparound bead-like structure which is breached only in midsection across the covered horizontal rod 20. This wraparound structure also protects the stick-on data sheets against wear, when identical pallet containers are stacked in close side-by-side relationship for transport and exposed to shaking during transport. The identification plate is thus secured substantially to only the three covered horizontal rods (abutting from outside thereagainst, with the extended rods of the rolled edge engaging behind), wherein the vertical rods are still further arranged between the horizontal rods and the thin-walled inner plastic container so that parts of the identification plate are absolutely prevented from touching the inner container.

Each pallet container 10 is typically equipped with two such identification plates 18, whereby one a sheet metal identification plate is disposed on the lattice frame 14 on the front side of the pallet container 10 above the discharge fitting, and the other sheet metal identification plate is secured in corresponding fashion on the lattice frame 14 on the backside of the lattice frame 14.

Identification plates may be dented or damaged during handling, transport or transfer of filled pallet containers. When repeatedly using such pallet containers, reconditioning is required. Damaged identification plate can be easily replaced hereby by a new identification plate so long the inner container is removed from the lattice frame and the sheet metal tongues (tabs) bent inwards as seal of originality have again been straightened out from the inside of the lattice frame.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. An identification plate for a pallet container, comprising a plate body for placement upon a lattice frame of a pallet container, said plate body having an upper edge, which is bent rearwards at a first angle for attachment to an upper horizontal rod of the lattice frame, a lower edge, which is bent rearwards at the first angle for attachment to a lower horizontal rod of the lattice frame, and opposite lateral edges extending between the upper and lower edges and bent rearwards at a second angle which is greater than the first angle, wherein each of the lateral edges ends at its rear in a rolled edge and is formed with terminal recesses for receiving the upper and lower horizontal rods, said rolled edge being sized to project with its ends in a rod-like manner into the recesses to engage behind the upper and lower horizontal rods.

2. The identification plate of claim 1, wherein the first and second angles are selected to adjust a distance of the upper and lower edges from the upper and lower horizontal rods and a distance of the lateral edges from respective vertical rods of the lattice frame so as to ensure a rattle-free securement to the lattice frame.

3. The identification plate of claim 1, wherein each of the lateral edges of the plate body has a further recess approximately in midsection for attachment to a further horizontal rod between the upper and lower horizontal rods, with the rolled edge of the lateral edge being sized to respectively project into the further recess and engaging behind the further horizontal rod.

4. The identification plate of claim 3, wherein the plate body has a front face which is formed with at least one U-shaped punched-out section disposed at a location directly below the further horizontal rod and provided with a tab appended on one side of the U-shaped section and bent rearwards to extend horizontally flatly from below against the further horizontal rod to form a seal of originality.

5. The identification plate of claim 3, wherein the plate body has a front face which is formed with at least one U-shaped punched-out section disposed at a location directly below the further horizontal rod and provided with a tab appended on one side of the U-shaped section and bent rearwards to extend vertically from below against an end face of the further horizontal rod to form a seal of originality.

6. The identification plate of claim 3, wherein the plate body has a front face which is formed with a lateral rib-shaped dimple disposed at a location immediately above the further horizontal rod for abutment against an outwardly pointing surface of the further horizontal rod.

7. The identification plate of claim 3, wherein the plate body has a front face which is formed with a wraparound bead-shaped structure at an outer area of the front face, said structure being breached in midsection in an area of the further horizontal rod.

8. In combination:

a pallet container for storage and transport of liquid or free-flowing materials, said pallet container including an inner thin-walled plastic container having an upper fill opening and a lower drain valve, a lattice frame disposed in close surrounding relationship to the plastic container and having horizontal lattice rods and vertical lattice rods which are welded together, and a bottom plate for support of the plastic container and attachment of the lattice frame; and an identification plate including a plate body for placement upon the lattice frame of the pallet container, said plate body having an upper edge, which is bent rearwards at a first angle for attachment to a first one of the horizontal lattice rods of the lattice frame, a lower edge, which is bent rearwards at the first angle for attachment to a second one of the horizontal lattice rods of the lattice frame, and opposite lateral edges extending between the upper and lower edges and bent rearwards at a second angle which is greater than the first angle, wherein each of the lateral edges ends at its rear in a rolled edge and is formed with terminal recesses for receiving the first and second horizontal lattice rods, said rolled edge being sized to project with its ends in a rod-like manner into the recesses to engage behind the first and second horizontal lattice rods.

9. The combination of claim 8, wherein the first and second angles are selected to adjust a distance of the upper and lower edges from the first and second horizontal lattice rods and a distance of the lateral edges from respective vertical lattice rods of the lattice frame so as to ensure a rattle-free securement to the lattice frame.

10. The combination of claim 8, wherein each of the lateral edges of the plate body has a further recess approximately in midsection for attachment to a third one of the horizontal lattice rods between the first and second horizontal lattice rods, with the rolled edge of the lateral edge being sized to respectively project into the further recess and engaging behind the third horizontal rod.

11. The combination of claim 10, wherein the plate body has a front face which is formed with at least one U-shaped punched-out section disposed at a location directly below the third horizontal lattice rod and provided with a tab appended on one side of the U-shaped section and bent rearwards to extend horizontally flatly from below against the third horizontal lattice rod to form a seal of originality.

12. The combination of claim 10, wherein the plate body has a front face which is formed with at least one U-shaped punched-out section disposed at a location directly below the third horizontal lattice rod and provided with a tab appended on one side of the U-shaped section and bent rearwards to extend vertically from below against an end face of the third horizontal lattice rod to form a seal of originality.

13. The combination of claim 10, wherein the plate body has a front face which is formed with a lateral rib-shaped dimple disposed at a location immediately above the third horizontal lattice rod for abutment against an outwardly pointing surface of the third horizontal lattice rod.

14. The combination of claim 10, wherein the plate body has a front face which is formed with a wraparound bead-shaped structure at an outer area of the front face, said structure being breached in midsection in an area of the third horizontal lattice rod.

15. A method of attaching an identification plate to a lattice frame of a pallet container, comprising the steps of:

providing an identification plate with upper and lower edges bent rearwards at a first angle, and opposite lateral edges extending between the upper and lower edges and bent rearwards at a second angle which is greater than the first angle, wherein each of the lateral edges ends at its rear in a rolled edge sized to jut out;

angling the identification plate in relation to a first horizontal rod of the lattice frame to thereby position the upper edge of the identification plate against the first horizontal rod and engage the rolled edge behind the first horizontal rod;

pivoting the identification plate in a direction toward the lattice frame until the rolled edge reaches behind a second horizontal rod of the lattice frame below the first horizontal rod;

pivoting the identification plate further in a direction toward the lattice frame until the lower edge of the identification plate engages a third horizontal rod of the lattice frame below the second horizontal rod and the rolled edge reaches behind the third horizontal rod; and pushing the identification plate downwards to engage the rolled edge behind the second horizontal rod and to engage the rolled edge behind the third horizontal rod.

16. The method of claim 15 wherein the pushing step includes the step of locking dimples formed in midsection of the identification plate behind an elevated edge of the second horizontal rod.

17. The method of claim 15, further comprising the step of bending tabs of the identification plate backwards to rest flatly against the second horizontal rod to establish a seal of authenticity.

18. The method of claim 15, further comprising the step of bending tabs of the identification plate backwards to rest flatly against a vertical rod of the lattice frame and vertically against an end face of the second horizontal rod to establish a seal of authenticity.

* * * * *

UNITED STATES PATENT AND TRADEMARK OFFICE

CERTIFICATE OF CORRECTION

PATENT NO. : 7,296,374 B2
APPLICATION NO. : 11/465553
DATED : November 20, 2007
INVENTOR(S) : Detlev Weyrauch et al.

It is certified that error appears in the above-identified patent and that said Letters Patent is hereby corrected as shown below:

On the Title Page, Item (30)

Please insert:

--[30] Foreign Application Priority Data

April 20, 2005 (DE) .....20 2005 006 351--

Signed and Sealed this

Fourth Day of November, 2008

JON W. DUDAS
*Director of the United States Patent and Trademark Office*